United States Patent [19]

Purlia et al.

[11] Patent Number: 4,683,603

[45] Date of Patent: Aug. 4, 1987

[54] GOLF BALL CLEANER

[76] Inventors: John M. Purlia; Stephen J. Jankowski, both of P.O. Box 4692, Scottsdale, Ariz. 85261

[21] Appl. No.: 737,213

[22] Filed: May 23, 1985

[51] Int. Cl.[4] ..... A63B 47/04

[52] U.S. Cl. ..... 15/104.94; 15/21 A; 15/104.92; 15/160; 15/210 R

[58] Field of Search ..... 15/21 A, 104.92, 104.94, 15/210 R, 160; 401/9, 268

[56] References Cited

U.S. PATENT DOCUMENTS

| | | | |
|---|---|---|---|
| 2,578,224 | 12/1951 | Cadman | 15/104.92 |
| 2,608,705 | 9/1952 | Duff | 15/21 A X |
| 3,981,039 | 9/1976 | Rumph | 15/21 A |
| 4,344,203 | 8/1982 | Gerrick | 15/21 A |

FOREIGN PATENT DOCUMENTS

| | | | |
|---|---|---|---|
| 8283 | of 1896 | United Kingdom | 15/21 A |
| 619324 | 3/1949 | United Kingdom | 15/21 A |

*Primary Examiner*—Edward L. Roberts
*Attorney, Agent, or Firm*—Berman, Aisenberg & Platt

[57] ABSTRACT

A cleaning device having particular utility for cleaning a golf ball is disclosed. A holding element includes a bottom, an upstanding wall, and an inwardly directed lip which forms an opening. A cleaning element is held within the device such that it is easily engaged by inserting a portion of the golf ball through the opening. The lip extends inwardly by a distance such that, when the cleaning device is in a generally vertical orientation, the lip, wall, and bottom form a reservoir to prevent the leakage of a cleaning fluid. The cleaning fluid is preferably water. The cleaning element is made of synthetic material and includes a woven pad backing and upwardly directed filaments. The woven backing provides a plurality of cavities for holding the cleaning fluid, while the filaments provide a surface for scrubbing the portion of the golf ball. Artificial turf is the preferred material for the cleaning element.

8 Claims, 3 Drawing Figures

GOLF BALL CLEANER

TECHNICAL FIELD

This invention relates to a cleaning device and finds particular utility in cleaning a golf ball.

BACKGROUND OF THE INVENTION

When golfing, it is frequently desired to clean a golf ball. In some instances, it is necessary to thoroughly scrub the entire exterior surface of a golf ball, while in other instances it is desired only to remove a smudge from the exterior surface. For example, when putting, it is frequently desirable to remove a single smudge from a golf ball.

Various types of golf ball cleaning devices are known in the art. Many of these are portable in some manner, and others are stationary and, for example, located at a tee for thoroughly cleaning the golf balls.

An example of a portable device for cleaning a golf ball is shown in U.S. Pat. No. 4,084,287 (Ingram, et al.). This device has an annular plastic casing with an annular sponge held therein, and the central hole in the annular sponge has a diameter slightly smaller than that of a golf ball. The process of cleaning comprises inserting the ball into the opening in the sponge and rotating the ball so that the entire exterior surface of the ball eventually contacts and is scrubbed by the surface of the sponge. The device is quite large because the annular nature of the sponge results in an overall diameter of the device being two to three times the diameter of a golf ball.

Another portable cleaning device is shown in U.S. Pat. No. 3,453,675 (Barton, et al.). This device comprises a partially spherical casing having a first interior part which is a reservoir for cleaning liquid and a second interior part which retains a cleaning sponge. A tube extends from the second part into the first part to allow measured dispensing of cleaning liquid from the reservoir into the sponge. Because of the requirement for a reservoir and a sponge, this device is quite thick and is not easily carried by a golfer. In fact, the device is designed for carrying on a string attached to a golfer's belt or a golf bag.

Yet another portable cleaning device is shown in U.S. Pat. No. 3,750,219 (MacConnell). This device includes a canister for holding a cleaning sponge. The upper edge of the canister wall is designed to sealingly engage a lid to prevent leakage of the cleaning liquid. The lid includes a protrusion which makes the device inconvenient to place in one's pocket, and it is necessary to employ two hands to remove the lid of the MacConnell device, thus complicating its use. Furthermore, the MacConnell device will leak cleaning liquid if the lid is not in place and the device is not horizontal.

SUMMARY OF THE INVENTION

None of the prior art portable cleaners is truly easy to carry or effective. Devices such as that shown by Barton are large and will not fit easily in the pocket of a golfer. The device of Ingram, et al. is clearly designed to be carried on a golf bag and has no possibility of being carried in a golfer's pocket. The MacConnell device, while it could be made small enough to fit in the pocket of a golfer, has a protrusion on the lid, requires the use of two hands to remove the lid, and requires the lid to be properly located to prevent leakage of liquid when in the pocket of a golfer.

In accordance with the invention, a cleaning device is provided which is quite small so that it is easily carried in the pocket of a golfer. An opening which need not be covered to prevent leakage of cleaning liquid allows immediate access to a cleaning pad, thus resulting in an extremely convenient device.

The cleaning device according to the invention comprises a holding element and a cleaning element. The holding element has a generally flat bottom, a wall extending upwardly from the bottom, and a lip extending inwardly from the upper edge of the wall to form an opening. A cleaning element is placed within the holder such that a portion of the ball inserted through the opening easily engages the cleaning element. The lip extends inwardly from the wall by an amount such that when the device is placed on its edge, with the opening lying in a generally vertical plane, any cleaning liquid which flows downwardly accumulates in a reservoir formed between the bottom, the wall, and the lip, and does not leak through the opening.

This structure allows a golfer to carry the cleaning device of the invention in his pocket. When it is desired to clean a ball, such as before beginning to putt, a golfer merely removes the cleaning device from his pocket with one hand and then cleans the ball by holding it in his other hand while engaging the ball with the cleaning element.

The cleaning element preferably comprises a woven backing with cleaning filaments extending upwardly from the backing. The woven backing provides a plurality of small cavities for receiving a cleaning fluid, which is preferably water. When the device is placed in a golfer's pocket, the cleaning fluid which is not retained in the pad does not leak out because it is retained in a reservoir formed between the bottom, the wall and the lip.

An object of this invention is to provide a cleaning device which comprises a holder having an opening and a cleaning element.

A further object of this invention is to provide a cleaning device having a holder with a generally flat bottom, an upstanding wall, and an inwardly directed lip which forms an opening for permitting access to a cleaning element.

Yet another object of this invention is to provide a thin, small cleaning device having an opening for allowing insertion of a golf ball wherein a lip, bottom, and wall form a reservoir to accumulate the cleaning liquid when the device is being carried to prevent the leakage of the cleaning liquid.

DETAILED DESCRIPTION OF THE INVENTION

Figure 1:
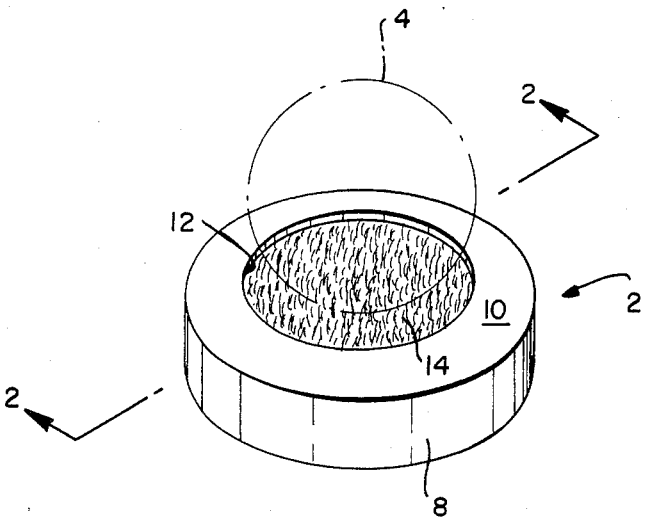
FIG. 1 is a perspective of a preferred embodiment of the invention.

FIG. 1 is a perspective of a cleaning device 2 having particular utility in cleaning a golf ball 4, which is shown in phantom lines.

The device 2 is designed to be thin to fit easily in the pocket of a golfer. A wall 8 extends upwardly from a bottom 6 (see FIG. 2), and a lip 10 extends radially inwardly from an upper edge of the wall 8. In the preferred embodiment, bottom 6 is circular and wall 8 is cylindrical. Bottom 6 is preferably flat to achieve the objective of being compact, but it may be slightly curved. Of course, other configurations could also be employed.

Lip 10 forms an opening 12 which is large enough to allow a golf ball 4 to be inserted through the opening and engage a cleaning element 14 retained in a cavity formed by the bottom 6, wall 8 and lip 10.

Figure 2:
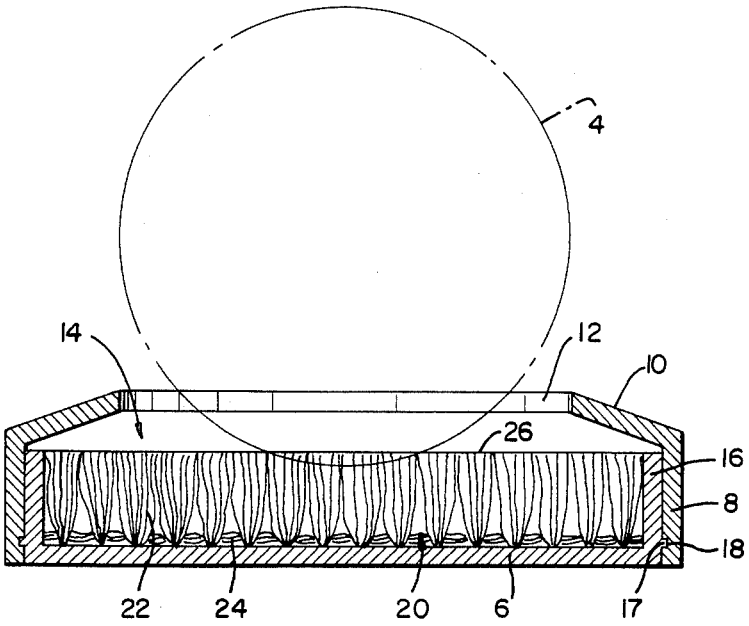
FIG. 2 is a cross section taken along line 2—2 of FIG. 1.

The construction of the cleaning device 2 will be more apparent from FIG. 2, which is a cross section taken along line 2—2 of FIG. 1. In this embodiment, the bottom 6, wall 8 and lip 10 form a means for holding the cleaning element 14. In the embodiment shown in FIG. 2, a first inner wall 16 extends upwardly from the bottom 6 and fits inside wall 8. Lip 10 extends inwardly from the upper edge of wall 8 and forms an opening 12.

When the cleaning device 2 is placed in a golfer's pocket 3 (see FIG. 3) any cleaning fluid which flows toward the lower part of the cleaning device will be retained between the bottom 6, the wall 8 (or inner wall 16) and the lip 10, and will not flow through the opening 12. Tests have shown successful cleaning with a relatively small amount of water used as a cleaning fluid, and this amount is easily retained in the reservoir.

The part formed by bottom 6 and inner wall 16 is secured to the part formed by lip 10 and wall 8 by the engagement of annular ridge 17 on wall 16 with annular groove 18 in wall 8. This connection is preferably such that the two parts may be separated if desired.

The cleaning element 14 comprises a backing 20 and filaments 22. Backing 20, in addition to providing a means for holding filaments 22, provides a honeycomb-like structure for holding the cleaning fluid. The backing is preferably woven to provide a plurality of openings, such as that shown at 24 between adjacent woven cords. The filaments 22 extend upwardly to form an upper surface 26 which is preferably spaced slightly below the bottom surface of the lip 10.

In a preferred embodiment, the cleaning element 14 is made of synthetic material and may be a product commonly known as "artificial turf". Thus, a backing 20 is formed of a woven synthetic material, and filaments 22 extend upwardly therefrom. The filaments are preferably formed by a combination of elements which terminate at upper surface 2 and elements which are looped over to provide a folded-over section at upper surface 26. This structure is easily capable of retaining a liquid such as water in the plurality of openings 24 and adhered to the surface of the filaments 22 to retain the cleaning fluid within the cleaning device. It is merely necessary periodically to add a small amount of water if the cleaning element has dried out because evaporation from this device has been found to be very slow.

It will be appreciated that the device according to the invention is not designed to scrub all surfaces of a golf ball simultaneously, but is designed instead to permit removal of a smudge from a rather limited portion of the exterior of a golf ball.

In a preferred embodiment, the bottom 6 is circular and has a diameter of from 2 to 3 inches, preferably approximately 2.1 inches. The cleaning device should be thin to easily fit in the golfer's pocket, and an overall height of about ½ of an inch has been found useful. It is preferred that the height be less than ¾ of an inch to provide easy insertion and removal of the cleaning device by the golfer.

Figure 3:
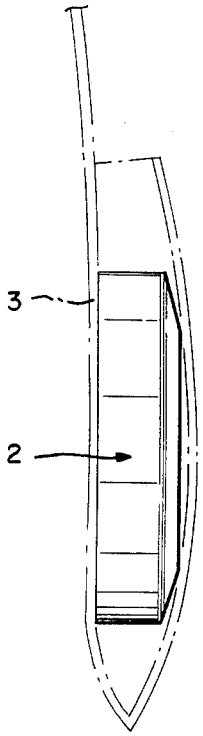
FIG. 3 is an end view of the device shown in figure 1 in a vertical orientation showing a golfer's pocket in phantom lines.

FIG. 3 shows the cleaning device 2 in the pocket 3 (phantom lines) of a golfer. When in this orientation, some of the cleaning fluid will naturally flow to a lower part of the cleaning device 2 because of its weight. Lip 10 extends inwardly from wall 8 by an amount which provides a reservoir between bottom 6, wall 8 and lip 10 of sufficient volume to prevent the cleaning fluid from flowing out of the opening 12. In a preferred embodiment, the opening 12 has a diameter of about 1½ inches.

In operation, the golfer carries the cleaning device 2 in his pocket until it is desired to remove a smudge from the exterior surface of a golf ball. Then, a golfer merely removes the cleaning device from his pocket and holds it in one hand in an orientation exposing the opening 12. The golf ball is held in the other hand and the smudged portion is inserted through the opening 12 and rubbed against the filaments 22 to remove the smudge. It will be appreciated that this operation is quite simple in that the cleaning deivce is always with the golfer and need not be hanging from the golf bag, which would require him to always go to the particular location of the bag to clean the golf ball. Furthermore, the opening 12 need not be covered resulting in a cleaning device which is ready for use upon merely removing it from one's pocket.

Modifications of the invention within the scope of the appended claims will be apparent to those of skill in the art.

What is claimed is:

1. Apparatus for cleaning a golf ball consisting of cleaning means for engaging a portion of the exterior surface of a golf ball and cleaning said portion, and holder means for holding said cleaning means and a cleaning liquid in sufficient quantity to allow said cleaning means to clean said portion, said holder means consisting of a generally flat bottom engaging said cleaning means, a wall extending upwardly from the outer perimeter of said bottom to an upper terminus, and a lip extending inwardly from said upper terminus to form an opening for allowing a golf ball to be inserted to engage said cleaning means, said cleaning means consisting of a pad having filaments extending upwardly therefrom to a height equal to or less than the top of said wall and substantially covering said bottom, wherein said wall and said bottom are secured together to provide a liquid-tight seal, and wherein said lip extends inwardly to form with said bottom and said wall a chamber of adequate size and containing a portion of said pad and filaments to prevent said cleaning liquid from flowing out of said opening when said opening lies in a vertical plane and said holder means contains said quantity of said cleaning liquid.

2. Apparatus according to claim 1 wherein said cleaning means is made of artificial turf.

3. Apparatus according to claim 2 wherein the height of said wall is such that a space exists between upper ends of said filaments and a bottom surface of said lip.

4. Apparatus according to claim 1 wherein said pad and said filaments are of synthetic material and said pad is woven to provide a plurality of openings for holding said cleaning fluid.

5. Apparatus according to claim 4 wherein said wall has a height less than three-quarters of an inch.

6. Apparatus according to claim 5 wherein said wall has a height of approximately one-half inch.

7. Apparatus according to claim 6 wherein said bottom is circular and has a diameter between two and three inches.

8. Apparatus according to claim 1 wherein said holder means comprises an inner element having a generally flat said bottom and a first cylindrical element extending upwardly from said bottom, and an outer element having a second cylindrical element fitting over said first cylindrical element, said first and second cylindrical elements being secured together by engagement of a ridge in a groove and wherein said lip is contiguous with said second cylindrical element.

* * * * *